US011629730B2

(12) United States Patent
Kimura

(10) Patent No.: US 11,629,730 B2
(45) Date of Patent: Apr. 18, 2023

(54) VACUUM PUMP

(71) Applicant: SHIMADZU CORPORATION, Kyoto (JP)

(72) Inventor: Hiroaki Kimura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 17/566,843

(22) Filed: Dec. 31, 2021

(65) Prior Publication Data

US 2022/0235797 A1 Jul. 28, 2022

(30) Foreign Application Priority Data

Jan. 25, 2021 (JP) ..... JP2021-009872

(51) Int. Cl.
*F04D 29/58* (2006.01)
*F04D 19/04* (2006.01)

(52) U.S. Cl.
CPC ..... *F04D 29/5853* (2013.01); *F04D 19/042* (2013.01)

(58) Field of Classification Search
CPC ..... F04D 19/042; F04D 19/044; F04D 19/046
See application file for complete search history.

(56) References Cited

U.S. PATENT DOCUMENTS

| | | | | |
|---|---|---|---|---|
| 3,341,893 | A * | 9/1967 | Edwards | B29C 51/04 264/296 |
| 10,267,337 | B2 * | 4/2019 | Tsubokawa | F04D 19/044 |
| 10,837,449 | B2 | 11/2020 | Kuno | |
| 2015/0345494 | A1 | 12/2015 | Tsubokawa | |
| 2016/0160877 | A1 | 6/2016 | Sakaguchi | |

FOREIGN PATENT DOCUMENTS

| | | | |
|---|---|---|---|
| CN | 105275835 | A | 1/2016 |
| CN | 105358835 | A | 2/2016 |
| JP | 2011169165 | * | 9/2011 |
| JP | 2015127525 | A | 7/2015 |
| JP | 2015-229935 | A | 12/2015 |
| JP | 2017155709 | * | 9/2017 |

OTHER PUBLICATIONS

Office Action for corresponding Taiwan Application No. 110133918, dated May 5, 2022, with English machine translation.

* cited by examiner

*Primary Examiner* — Woody A Lee, Jr.
*Assistant Examiner* — Brian O Peters
(74) *Attorney, Agent, or Firm* — Renner, Otto, Boisselle & Sklar, LLP

(57) ABSTRACT

A vacuum pump comprises: a cylindrical rotor; multiple heat insulating pins; and a stator having a cylindrical portion arranged with a predetermined gap in an outer peripheral side of the rotor and a fixing portion to be fixed to a pump base through the multiple heat insulating pins. The heat insulating pins have a lower thermal conductivity than those of the stator and the pump base, and support the fixing portion.

8 Claims, 10 Drawing Sheets

(FIRST COMPARATIVE EXAMPLE)

FIG. 5

| | | CONFIGURATION A | CONFIGURATION B |
|---|---|---|---|
| TEMPER-ATURE | REGION R1 | 172°C | 170°C |
| | REGION R2 | 156°C | 165°C |
| TEMPERATURE DIFFERENCE | | 16°C | 5°C |

(SECOND COMPARATIVE EXAMPLE)

(FIRST VARIATION)

(SECOND VARIATION)

VACUUM PUMP

BACKGROUND OF THE INVENTION

1. Technical Field

The present invention relates to a vacuum pump.

2. Background Art

A turbo-molecular pump is used as an exhaust pump for various semiconductor manufacturing devices. However, when gas is discharged in, e.g., an etching process, a reactive product is accumulated inside the pump. In the turbo-molecular pump, a rotor rotates at a high speed with a gap from a stator. If the reactive product is accumulated inside the pump upon etching, the clearance between the rotor and the stator is eventually filled with the reactive product, and the reactive product is fixed, and due to this, rotation operation cannot be performed in some cases. For reducing such product accumulation inside the pump, in, e.g., a vacuum pump described in Patent Literature 1 (JP-A-2015-229935), a stator 22 is, with reference to FIGS. 1 to 3 of Patent Literature 1, supported by a cylindrical heat insulating member 24, and is directly heated by a heater 280.

SUMMARY OF THE INVENTION

However, due to influence of heat transfer from the stator 22 to a base 30 through the heat insulating member 24, there is a problem that a temperature difference between a region contacting the heater 280 and a region apart from such a contact region in a circumferential direction tends to be great and product accumulation becomes noticeable in the low-temperature far region.

A vacuum pump comprises: a cylindrical rotor; multiple heat insulating pins; and a stator having a cylindrical portion arranged with a predetermined gap in an outer peripheral side of the rotor and a fixing portion to be fixed to a pump base through the multiple heat insulating pins. The heat insulating pins have a lower thermal conductivity than those of the stator and the pump base, and support the fixing portion.

According to the present invention, variation in the temperature of a cylindrical portion of a stator heated by heaters can be reduced.

BRIEF DESCRIPTION OF THE DRAWINGS

FIG. 5 is a table for describing an effect obtained by stepped pins;

DETAILED DESCRIPTION OF THE EXEMPLARY EMBODIMENTS

Figure 1:
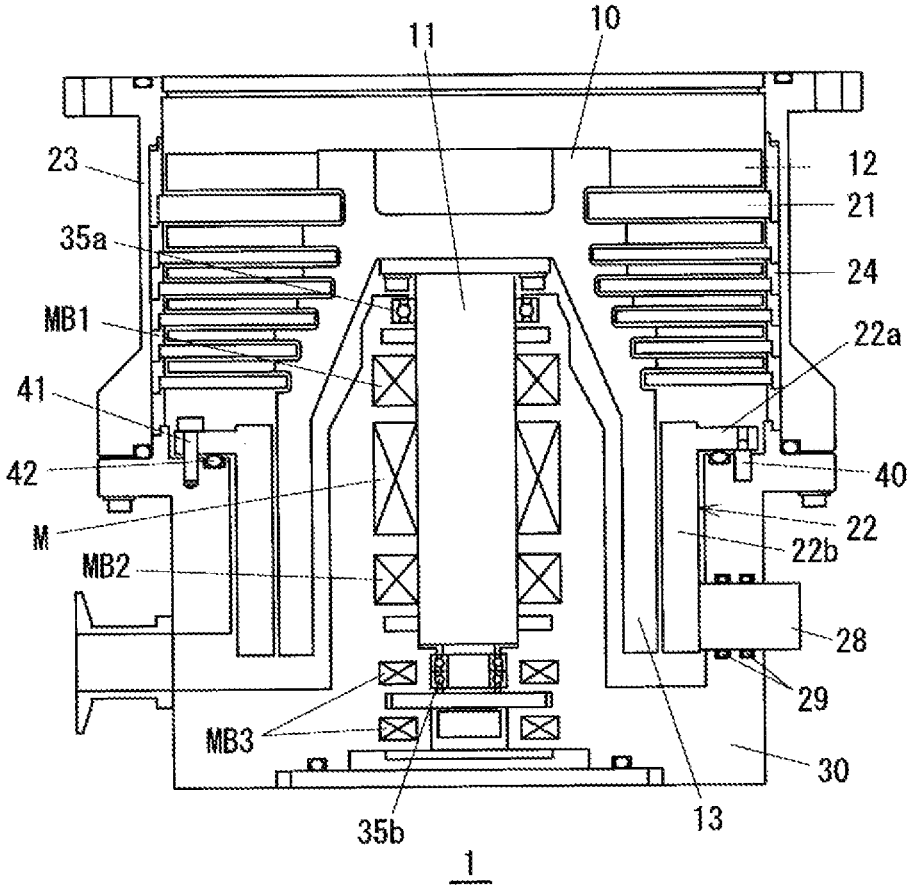
FIG. 1 is a view showing one embodiment of a vacuum pump according to the present invention, and shows the section of a turbo-molecular pump.

Hereinafter, a mode for carrying out the present invention will be described with reference to the drawings. FIG. 1 is a view showing one embodiment of a vacuum pump according to the present invention, and shows the section of a turbo-molecular pump. The turbo-molecular pump 1 includes a rotor 10 formed with multiple stages of rotor blades 12 and a rotor cylindrical portion 13. In a pump case 23, multiple stages of stator blades 21 are arranged and stacked corresponding to the multiple stages of the rotor blades 12. The multiple stages of the stator blades 21 stacked in a pump axial direction are arranged on a base 30 through spacers 24. Each of the rotor blades 12 and the stator blades 21 includes multiple turbine blades arranged in a circumferential direction.

A cylindrical stator 22 is provided to surround the rotor cylindrical portion 13 of the rotor 10. At the stator 22, a stator cylindrical portion 22*b* arranged with a predetermined gap in an outer peripheral side of the rotor cylindrical portion 13 and a flange portion 22*a* for fixing the stator 22 to the base 30 as a pump housing are formed. A screw groove is formed at either one of an outer peripheral surface of the rotor cylindrical portion 13 or an inner peripheral surface of the stator 22, and the rotor cylindrical portion 13 and the stator 22 form a screw groove pump. The stator cylindrical portion 22*b* is arranged in the base 30, and the flange portion 22*a* is fixed to an upper end of the base 30 with bolts 41. The stator cylindrical portion 22*b* is heated by heaters 28.

A rotor shaft 11 is fixed to the rotor 10. The rotor shaft 11 is magnetically levitated and supported by radial magnetic bearings MB1, MB2 and an axial magnetic bearing MB3, and is rotatably driven by a motor M. When the magnetic bearings MB1 to MB3 are not in operation, the rotor shaft 11 is supported by mechanical bearings 35*a*, 35*b*.

Figure 2:
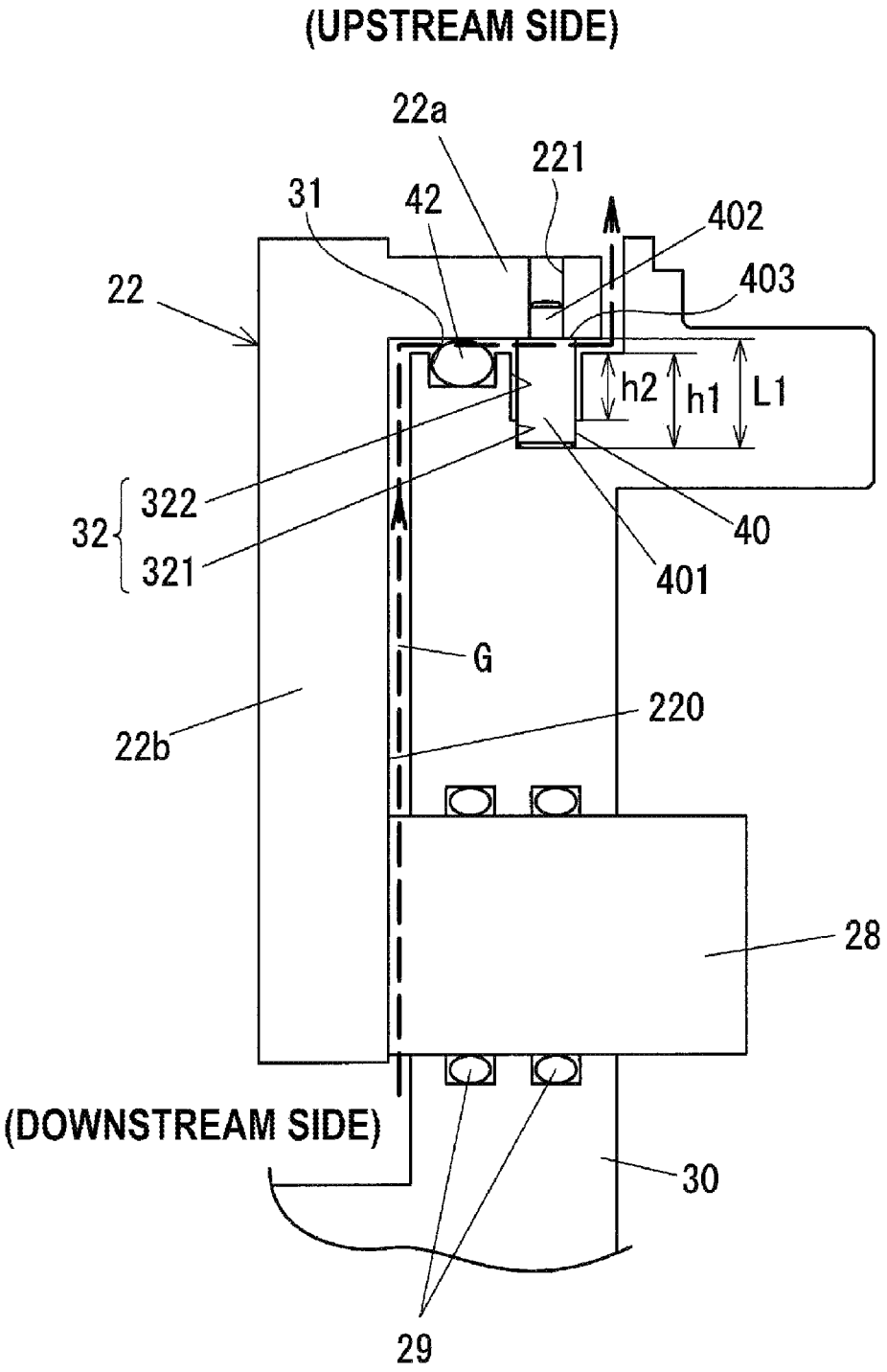
FIG. 2 is an enlarged view showing the half sections of a stator and a heater placed on a base.
Figure 3:
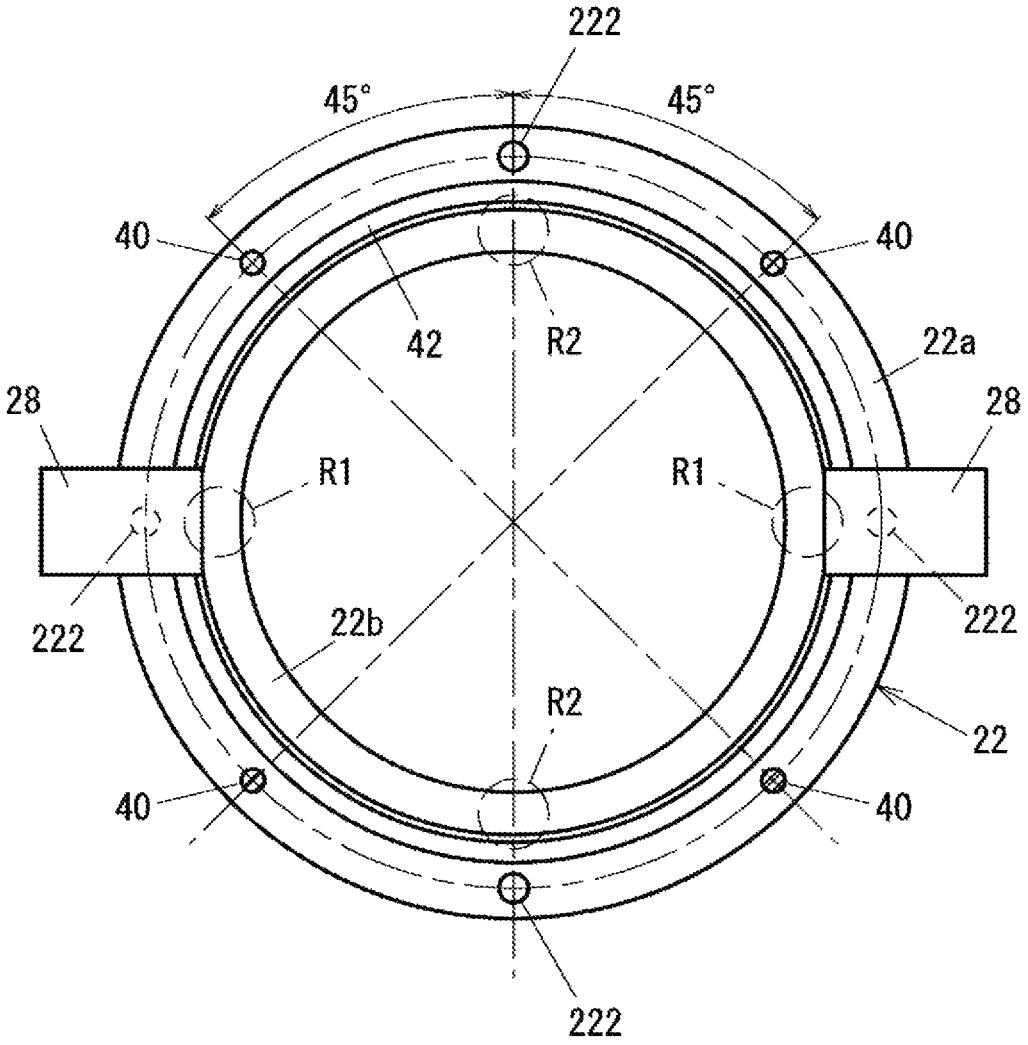
FIG. 3 is a view of the stator and the heater from a base bottom side.

FIG. 2 is an enlarged view showing the half sections of the stator 22 and the heater 28 placed on the base 30. Moreover, FIG. 3 is a view showing the stator 22 and the heater 28 from a base bottom side. As shown in FIG. 2, the heater 28 configured to heat the stator 22 is provided to penetrate the base 30 from the outer peripheral side to the inner peripheral side. A tip end of the heater 28 inserted into an internal space of the base 30 thermally contacts a predetermined region of an outer peripheral surface 220 of a lower portion of the stator cylindrical portion 22*b* provided at the stator 22. A back end of the heater 28 is exposed to the outside of the base 30, and a clearance between the heater 28 and the base 30 is sealed by an O-ring 29. Although not shown in the figure, the heater 28 is provided with a temperature sensor, and heats the stator 22 at a predetermined temperature. In the embodiment, two heaters 28 are provided at a phase of 180° in the circumferential direction, but three or more heaters 28 may be provided.

Note that in the embodiment, the sectional shape of the tip end contact portion of the heater 28 is in a circular shape, but is not limited to the circular shape. The tip end contact portion of the heater 28 is preferably processed into a shape in accordance with the shape of a stator outer peripheral surface to contact the stator 22 without any clearance. The tip end contact portion of the heater 28 may thermally contact the stator 22 through another member (e.g., a member which is easily deformable in accordance with contact surface asperities and has a high thermal conductivity) . Alternatively, the entirety of the heater 28 may be arranged in the pump.

An O-ring groove 31 in which an O-ring 42 is to be arranged is formed at an upper end surface (hereinafter referred to as a stator fixing surface for the sake of convenience) of the base 30 to which the stator 22 is fixed. The O-ring 42 is provided in a clearance between the base 30 and the stator 22 so that the backflow of gas from the downstream side to the upstream side of the stator 22 through a clearance as indicated by a dashed arrow G can be reliably prevented. Needless to say, in a case where influence of the backflow is acceptable, the O-ring 42 maybe omitted. Multiple pin holes 32 are formed at the stator fixing surface on the outer peripheral side with respect to the O-ring groove 31, and stepped pins 40 are each inserted into the pin holes 32. The pin hole 32 includes a small-diameter hole portion 321 on a hole far side and a large-diameter hole portion 322 on a hole inlet side.

A large-diameter portion 401 of the stepped pin 40 engages with the small-diameter hole portion 321 of the pin hole 32, and a clearance is formed between the large-diameter portion 401 and the large-diameter hole portion 322. The stator 22 is supported by step portions 403 of the stepped pins 40, and in this manner, positioning in the pump axial direction is performed. A small-diameter portion 402 of the stepped pin 40 engages with a pin hole 221 formed at the flange portion 22a of the stator 22, and for phases in a radial direction and the circumferential direction, positioning of the stator 22 is performed. Note that the pin hole 221 penetrates the flange portion 22*a* in FIG. 2, but does not necessarily penetrate the flange portion 22*a*. Moreover, the stepped pin 40 may be fixed to a base side, or may be fixed to a flange portion side.

As shown in FIG. 3, four bolt holes 222 into which the bolts 41 (see FIG. 1) for fixing are to be inserted are formed at a phase of 90° at the flange portion 22*a*. Four stepped pins 40 are arranged at a phase of 90° at positions shifted from those of the bolt holes 222 by a phase of 45°. Two heaters 28 are provided at a phase of 180° in the circumferential direction. Assuming that heat flows into the stator 22 from the heater 28 and is released from a portion where the stator 22 thermally contacts the base 30, temperature distribution is shown such that a temperature is high in a contact region where the heater 28 contacts the stator 22 as indicated by a reference character R1 and is low in a region R2 far from the contact region R1.

The stepped pin 40 is a member configured to adiabatically perform positioning of the stator 22 relative to the base 30, and is made of a material having a lower thermal conductivity than those of the stator 22 and the base 30. Generally, the stator 22 and the base 30 are made of an aluminum material, and therefore, e.g., a stainless steel material or a ceramics material having a lower thermal conductivity than those of the stator 22 and the base 30 is used for the stepped pin 40. The stepped pin 40 supports, by the step portion 403, the flange portion 22*a* of the stator 22. The length dimension L1 of the large-diameter portion 401 is set greater than the depth dimension h1 of the pin hole 32, and therefore, a clearance is formed between the base 30 and the flange portion 22*a*. Moreover, a clearance is also formed between the outer peripheral surface of the stator 22 and an inner peripheral surface of the base 30. That is, the stator 22 does not contact the base 30.

Figure 4:
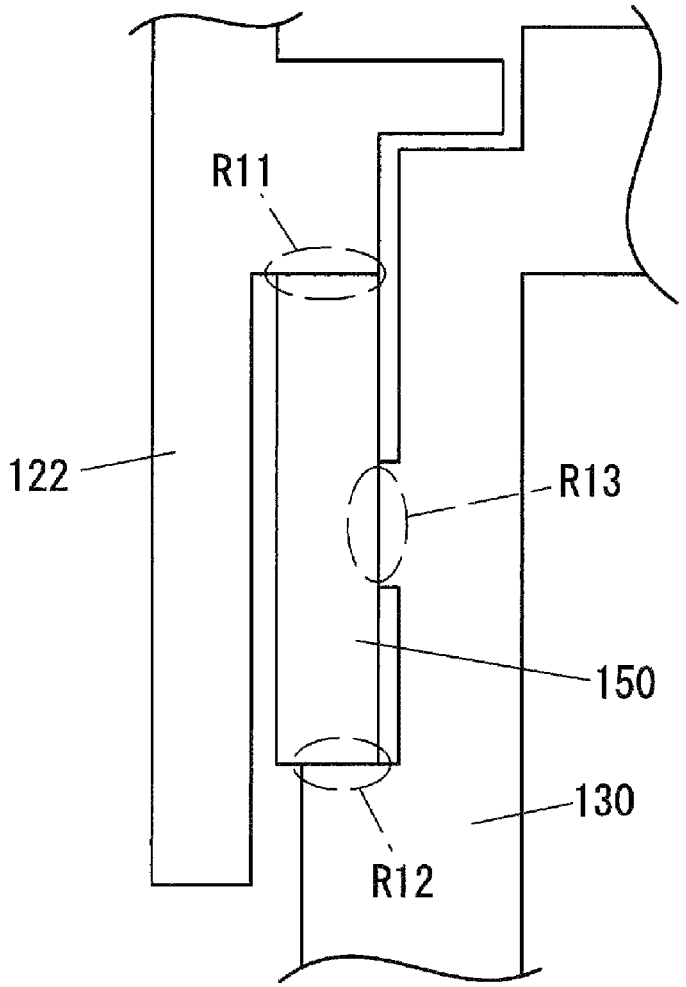
FIG. 4 is a view showing a first comparative example.

FIG. 4 is a view showing a first comparative example, and shows a configuration similar to a typical stator fixing structure described in Patent Literature 1. In the first comparative example, a stator 122 is supported by a cylindrical heat insulating member 150. The heat insulating member 150 contacts the stator 122 at a contact portion R11, and contacts a base 130 at contact portions R12, R13. In the case of the stator support structure as shown in FIG. 4, the contact portions R11, R12, R13 extend across an entire circumference of 360° of the heat insulating member 150, and therefore, as compared to the case of local support by the stepped pins 40 as shown in FIGS. 2 and 3, heat transfer from the heated stator 122 to the base 130 tends to increase. Such heat transfer is caused due to a temperature difference, and for this reason, in a case where the stator 122 is heated by the heaters 28 arranged at a phase of 180° as shown in FIG. 3, variation in temperature distribution of the stator 122 in the circumferential direction tends to be great.

On the other hand, in the present embodiment, the flange portion 22*a* of the stator 22 is locally supported by the multiple heat-insulating stepped pins 40, and therefore, heat transfer from the stator 22 heated by the heaters 28 to the base 30 can be sufficiently reduced. As a result, a temperature difference between the contact region R1 and the region R2 in FIG. 3 can be reduced as compared to the typical case.

As shown in FIG. 2, the small-diameter hole portion 321 and the large-diameter hole portion 322 are formed at the pin hole 32, and the clearance is formed between the large-diameter hole portion 322 and the large-diameter portion 401 of the stepped pin 40. In FIG. 2, h1 is the depth dimension of the entirety of the pin hole 32, and h2 is the depth dimension of the large-diameter hole portion 322. Moreover, L1 is the length dimension of the large-diameter portion 401 of the stepped pin 40. The dimension of the clearance between the flange portion 22*a* and the base 30 is (L1-h1). Moreover, a distance from the step portion 403 contacting the flange portion 22*a* to a contact portion between the large-diameter portion 401 and the small-diameter hole portion 321, i.e., the length dimension of a heat insulating path is (L1-(h1-h2)), and is longer than the clearance dimension (L1-h1) by h2. Thus, even in a case where the clearance (L1-h1) between the flange portion 22*a* and the base 30 is set to a small value, the dimension h2 is set to a great value so that a sufficient heat insulating effect can be obtained. Needless to say, even in the case of h2=0, the stepped pin 40 is made of the material having a lower thermal conductivity than those of the base 30 and the stator 22, and due to the heat insulating effect thereof, the effect of reducing variation in the temperature of the stator in the circumferential direction is obtained.

FIG. 5 shows one example of an effect obtained by use of the stepped pins 40. FIG. 5 shows simulation results under the same heating conditions, and shows the temperatures of the regions R1, R2 in a typical configuration A in which the stator 122 is supported by the heat insulating member 150 as in the first comparative example and a configuration B in which four locations are supported at a phase of 90° by means of the stepped pins 40 as in the present embodiment. A temperature difference between the contact region R1 and the region R2 is 16° C. in the typical configuration A, but is reduced to 5° C. in the case of the configuration B. The temperature difference is reduced as described above, and therefore, the amount of product accumulation on the stator cylindrical portion 22*b* is uniformized by reduction in variation due to the position in the circumferential direction and maintenance timing for accumulated product removal can be extended ahead.

Figure 6:
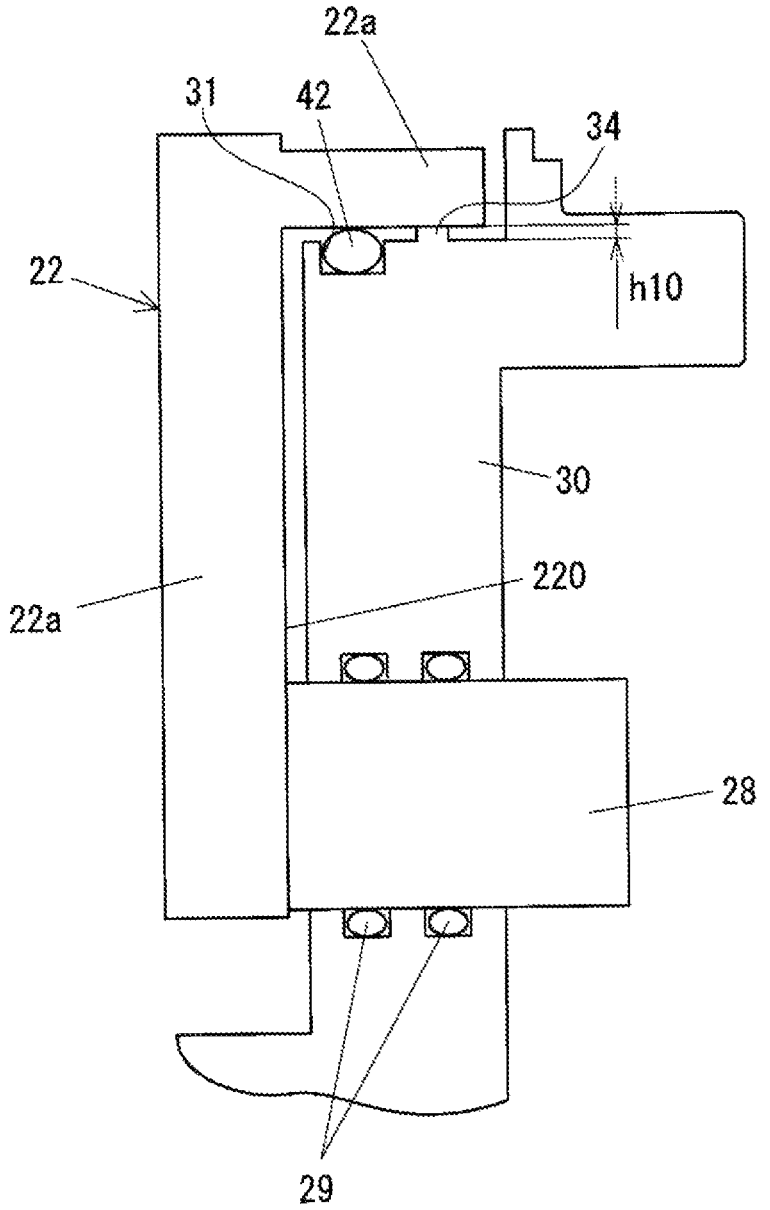
FIG. 6 is a view showing a second comparative example.

FIG. 6 is a view showing a second comparative example, and multiple raised portions 34 with a height h10 are formed on a base surface facing the flange portion 22*a*. Arrangement of the multiple raised portions 34 is similar to arrangement of the stepped pins 40 of FIG. 3. In the case of the second comparative example, the stator 22 is locally supported at multiple locations, but such a configuration is different from the configuration of FIG. 2 in that the thermal conductivity of the raised portion 34 is the same as that of the base 30 and the height dimension h10 of the raised portion 34, i.e., the length of the heat insulating path, is extremely smaller than (L1-(h1-h2)) of the configuration of FIG. 2. Thus, a sufficient heat insulating effect is not obtained, and variation in the temperature of the stator 22 in the circumferential direction tends to be great.

(First Variation)

Figure 7:
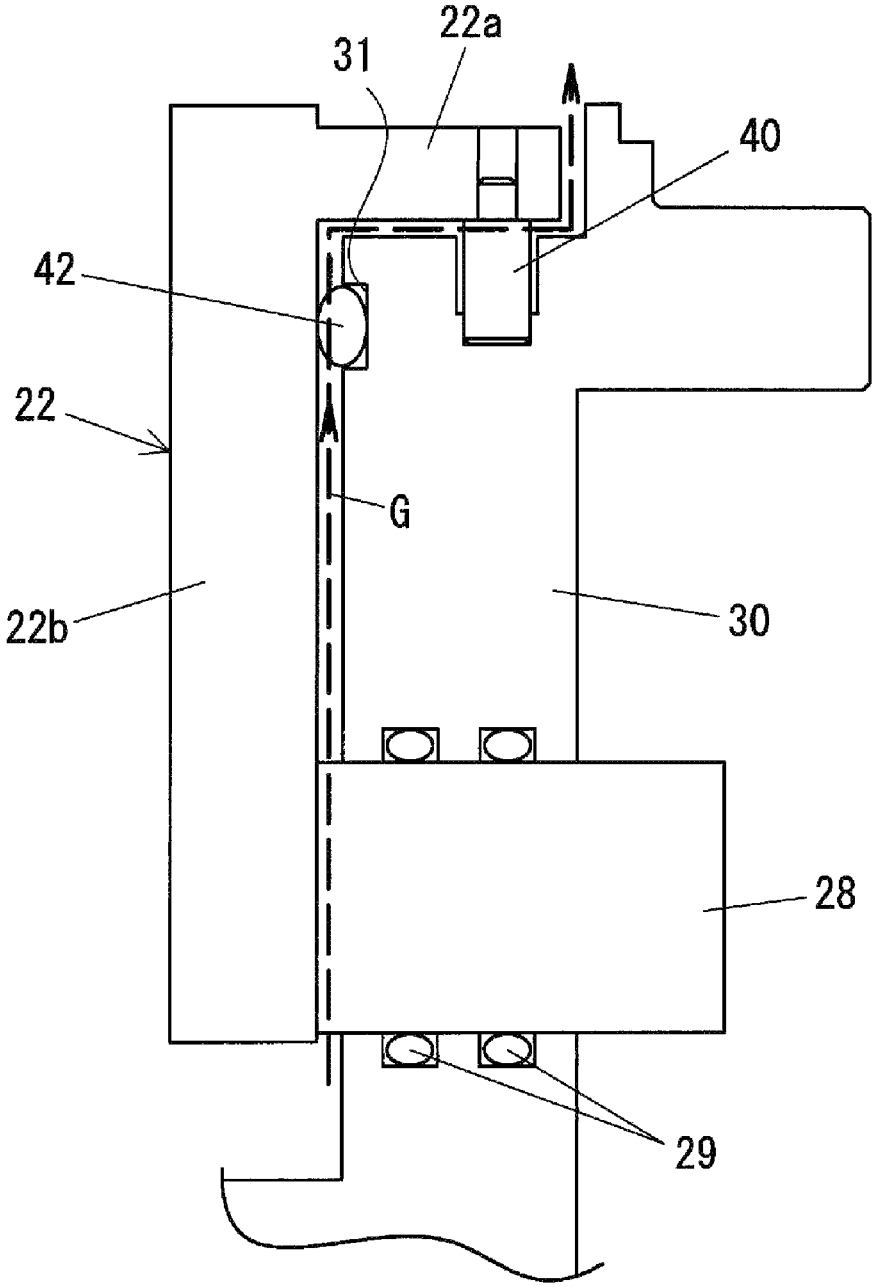
FIG. 7 is a view showing a first variation.

FIG. 7 is a view showing a first variation of the present embodiment. In the first variation, the O-ring 42 is arranged between the outer peripheral surface of the stator 22 and the inner peripheral surface of the base 30 as in a shaft seal. The O-ring 42 is arranged as described above so that the gas backflow as indicated by the dashed arrow G can be also prevented. In FIG. 7, the O-ring groove 31 is provided at the base 30, but may be provided at the stator 22. Similarly, in the configuration shown in FIG. 2, the O-ring groove 31 may be provided on a flange portion 22*a* side.

(Second Variation)

Figure 8:
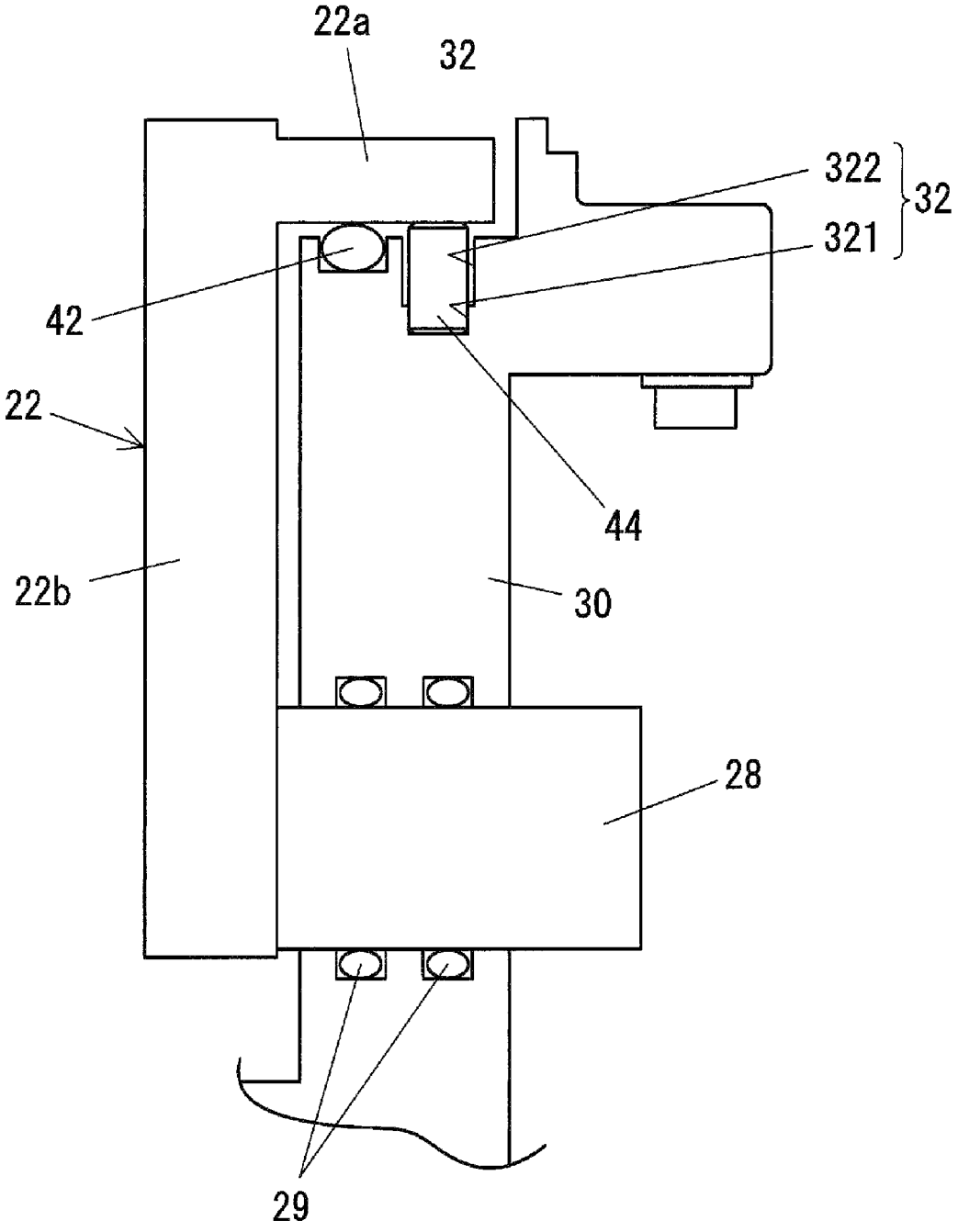
FIG. 8 is a view showing a second variation.

FIG. 8 is a view showing a second variation of the present embodiment. In the second variation, a configuration using parallel pins 44 instead of the stepped pins 40 is employed. As in the stepped pin 40, the parallel pin 44 is made of a material having a lower thermal conductivity than those of the stator 22 and the base 30. The configuration of the pin hole 32 into which the parallel pin 44 is to be inserted is similar to that of the pin hole 32 shown in FIG. 2. That is, the pin hole 32 has the small-diameter hole portion 321 engaging with the parallel pin 44 and the large-diameter hole portion 322 configured such that a clearance is formed between the large-diameter hole portion 322 and the parallel pin 44. In the case of this configuration, the flange portion 22*a* of the stator 22 is supported by the multiple parallel pins 44, and in this manner, positioning of the stator 22 in the pump axial direction is performed.

Figure 9:
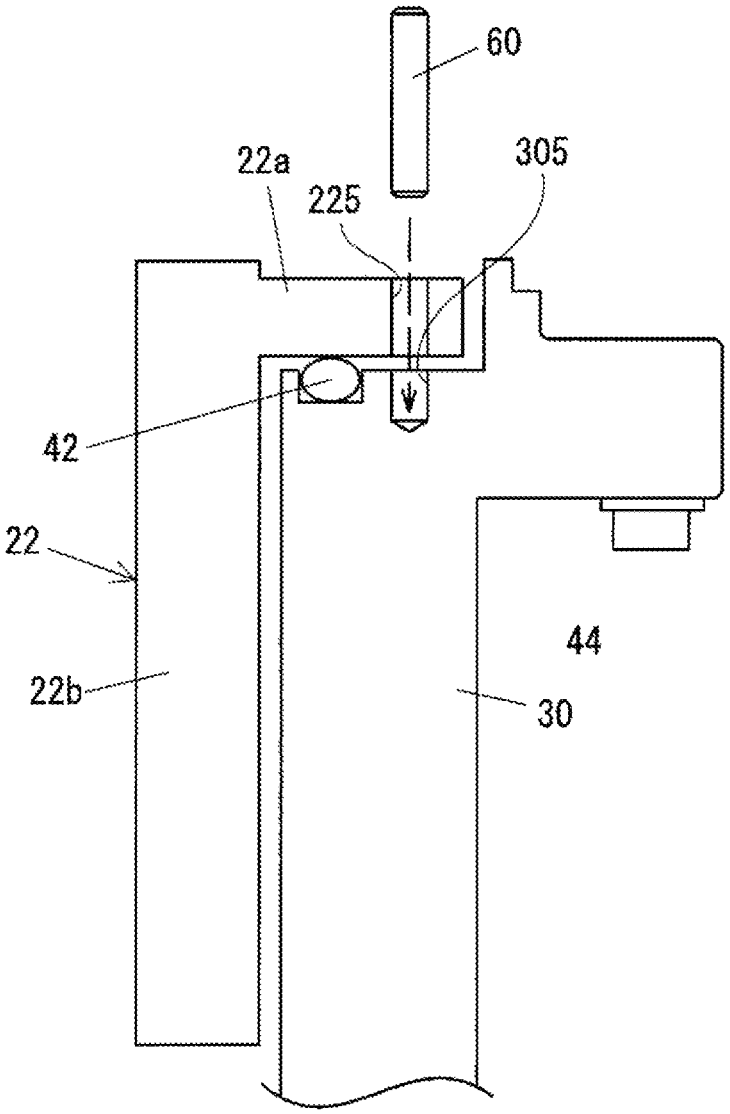
FIG. 9 is a view for describing positioning steps in the second variation.

Note that in the second variation, positioning of the stator 22 for the phases in the radial direction and the circumferential direction is performed as shown in FIG. 9, for example. A sectional view shown in FIG. 9 is a longitudinal sectional view (a sectional view similar to that in the case of FIG. 2) at a position shifted from the bolt hole 222 of the FIG. 3 by a phase of 22.5°. The parallel pin 44 is arranged at a position shifted from the bolt hole 222 by a phase of 45°. As shown in FIG. 9, a through-hole 225 for positioning is formed at the flange portion 22*a* of the stator 22. A hole 305 for positioning is formed at a position facing the through-hole 225 at the base 30. The through-hole 225 and the hole 305 are also formed at positions shifted by a phase of 180°.

When the stator 22 is fixed to the base 30 with the bolts 41 shown in FIG. 1, positioning pins 60 are inserted into the through-holes 225 and the holes 305, and in this manner, positioning of the stator 22 for the phases in the radial direction and the circumferential direction is performed. In a positioning state, the stator 22 is fixed to the base 30 with the bolts 41, and thereafter, the positioning pins 60 are detached from the through-holes 225 and the holes 305. By the above-described steps, the stator 22 is positioned and fixed to the base 30.

Those skilled in the art understand that the above-described exemplary embodiment and variations are specific examples of the following aspects.

Note that it is configured such that the stator 22 is heated by the heaters 28 in the above-described embodiment and variations, but the temperature of the stator 22 is higher than that of the base 30 due to heat generation accompanied by gas discharge even in a configuration without the heaters 28. Thus, it is configured such that the stator 22 is supported by heat insulating pins as in the above-described embodiment. With this configuration, uniformity of the temperature distribution of the stator 22 can be improved.

[1] A vacuum pump comprises: a cylindrical rotor; multiple heat insulating pins; and a stator having a cylindrical portion arranged with a predetermined gap in an outer peripheral side of the rotor and a fixing portion to be fixed to a pump base through the multiple heat insulating pins. The heat insulating pins have a lower thermal conductivity than those of the stator and the pump base, and support the fixing portion.

For example, even in a case where the temperature of the stator 22 reaches a temperature higher than that of the base 30 due to heat generation accompanied by gas discharge, the flange portion 22*a* of the stator 22 is supported by the stepped pins 40 as the heat insulating pins, and therefore, heat transfer from the stator 22 to the base 30 can be sufficiently reduced. Thus, the uniformity of the temperature distribution of the stator 22 in the circumferential direction can be improved.

[2] The vacuum pump further comprises: a heater configured to heat a predetermined region of the cylindrical portion of the stator.

For example, as shown in FIG. 2, the flange portion 22*a* of the stator 22 is supported by the stepped pins 40 as the heat insulating pins so that heat transfer from the stator 22 heated by the heaters 28 to the base 30 can be sufficiently reduced. As a result, the temperature difference between the contact region R1 and the region R2 in FIG. 3 can be reduced as compared to the typical case. Similar features and advantageous effects are also obtained in the first and second variations.

[3] The heat insulating pins further perform positioning of the stator in a pump axial direction.

[4] Each heat insulating pin is a stepped pin having a large-diameter portion engaging with a pin hole formed at the pump base and a small-diameter portion engaging with a pin hole formed at the fixing portion of the stator, and the fixing portion of the stator is supported by a step portion formed at a boundary between the small-diameter portion and the large-diameter portion of the stepped pin, and positioning of the stator in the pump axial direction, a stator radial direction, and a stator circumferential direction is performed by the stepped pin.

With use of the stepped pins 40 as shown in FIG. 2, positioning of the stator 22 in the pump axial direction is performed by support by the step portions 403, and positioning of the stator 22 for the phases in the radial direction and the circumferential direction is performed by engagement of the small-diameter portions 402 with the pin holes 221, for example.

[5] A pin hole formed at the pump base and engaging with each heat insulating pin includes a hole-far-side small-diameter hole portion engaging with each heat insulating pin and a hole-inlet-side large-diameter hole portion configured such that a clearance is formed between the large-diameter hole portion and each heat insulating pin.

For example, as shown in FIG. 2, the large-diameter portion 401 of the stepped pin 40 engages only with the small-diameter hole portion 321 formed on the hole far side of the pin hole 32, and the clearance is formed between the large-diameter portion 401 and the large-diameter hole portion 322. Thus, the length h2 of the heat insulating path for the stepped pin 40 can be greater than the dimension (L1-h1) of the clearance between the flange portion 22*a* and the base 30, and the heat insulating effect obtained by the stepped pins 40 can be more improved.

[6] The vacuum pump, further comprises: a seal member arranged in a clearance between the pump base and the stator and configured to prevent a gas backflow from a downstream side to an upstream side of the stator through the clearance.

Figure 10:
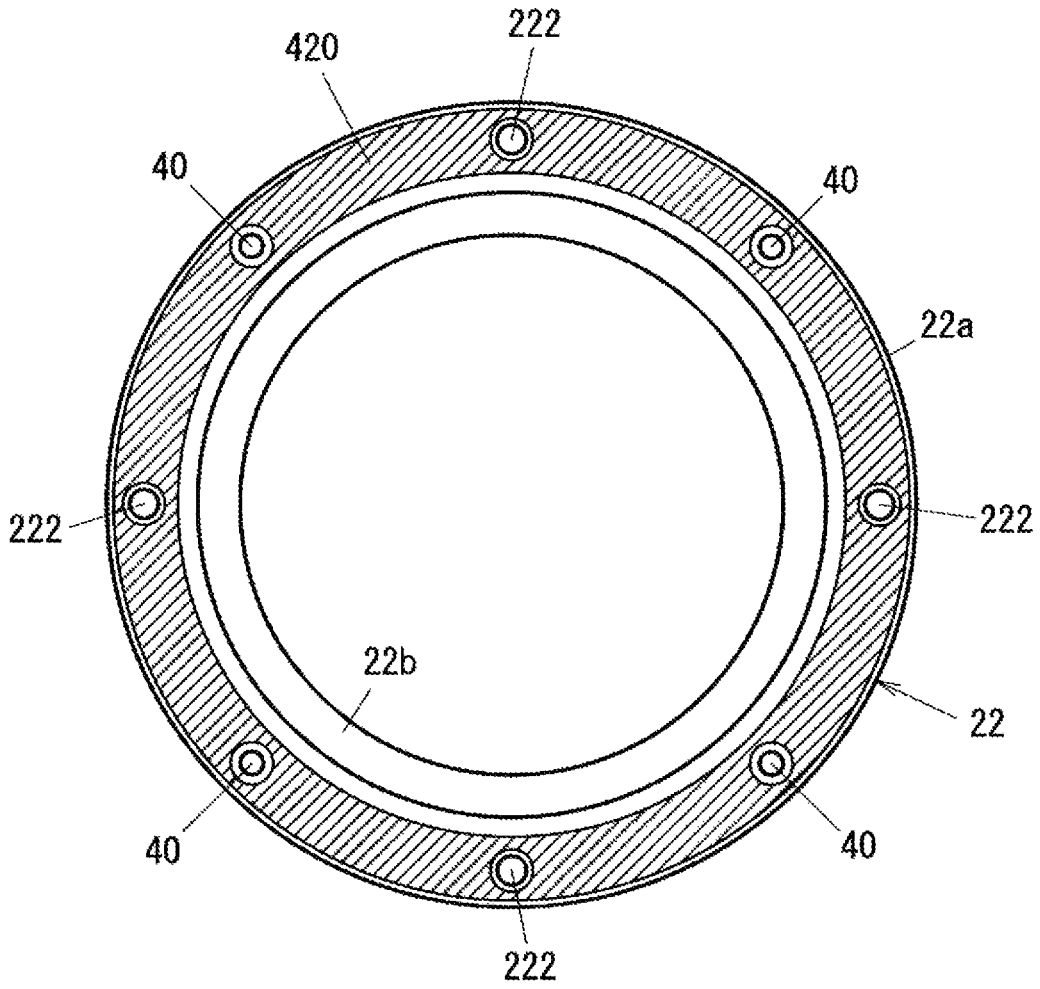
FIG. 10 is a view showing a case where a plate-shaped packing is used as a seal member.

For example, as shown in FIG. 2, the stator 22 is supported by the stepped pins 40. With this configuration, even when the clearance is formed between the base 30 and the stator 22, the O-ring 42 as a seal member is provided so that the gas backflow G from the downstream side to the upstream side of the stator 22 can be prevented and influence on pump performance degradation can be prevented. Note that in the above-described embodiment, the O-ring 42 is used as the seal member, but a plate-shaped packing made of a material (e.g., resin or rubber) having a lower thermal conductivity than those of the stator 22 and the base 30 may be used. For example, a packing 420 in a shape as shown in FIG. 10 can be used to prevent the gas backflow.

[7] The stator does not contact the pump base.

[8] The heat insulating pins are provided at predetermined angular phase intervals in the circumferential direction.

Note that as shown in FIG. 1, the stator 22 supported by the stepped pins 40 is fixed to the base 30 with the metal bolts 41. Thus, for reducing influence of heat transfer through the bolt 41, the bolt 41 may be made of, e.g., stainless steel having a lower thermal conductivity than that of an aluminum material, or a washer made of, e.g., a stainless steel material or ceramics may be attached to between the bolt 41 and the flange portion 22*a*.

Various embodiments and variations have been described above, but the present invention is not limited to the contents of these embodiments and variations. Other aspects conceivable within the scope of the technical idea of the present invention are also included in the scope of the present invention. For example, in the above-described embodiments, the turbo-molecular pump has been described as an example, but the present invention can be also applied to a vacuum pump including only a screw groove pump having a stator and a rotor cylindrical portion.

What is claimed is:

1. A vacuum pump comprising:

a cylindrical rotor;

multiple heat insulating pins; and a stator having a cylindrical portion arranged with a predetermined gap in an outer peripheral side of the rotor and a fixing portion to be fixed to a pump base through the multiple heat insulating pins, wherein the heat insulating pins have a lower thermal conductivity than those of the stator and the pump base, and support the fixing portion in an axial direction.

2. The vacuum pump according to claim 1, further comprising:

a heater configured to heat a predetermined region of the cylindrical portion of the stator.

3. The vacuum pump according to claim 1, wherein the heat insulating pins further perform positioning of the stator in a pump axial direction.

4. The vacuum pump according to claim 1, further comprising:

a seal member arranged in a clearance between the pump base and the stator and configured to prevent a gas backflow from a downstream side to an upstream side of the stator through the clearance.

5. The vacuum pump according to claim 1, wherein the stator does not contact the pump base.

6. The vacuum pump according to claim 1, wherein the heat insulating pins are provided at predetermined angular phase intervals in the circumferential direction.

7. A vacuum pump comprising:

a cylindrical rotor;

multiple heat insulating pins; and a stator having a cylindrical portion arranged with a predetermined gap in an outer peripheral side of the rotor and a fixing portion to be fixed to a pump base through the multiple heat insulating pins, wherein the heat insulating pins have a lower thermal conductivity than those of the stator and the pump base, and support the fixing portion, wherein each heat insulating pin is a stepped pin having a large-diameter portion engaging with a pin hole formed at the pump base and a small-diameter portion engaging with a pin hole formed at the fixing portion of the stator, and the fixing portion of the stator is supported by a step portion formed at a boundary between the small-diameter portion and the large-diameter portion of the stepped pin, and positioning of the stator in the pump axial direction, a stator radial direction, and a stator circumferential direction is performed by the stepped pin.

8. A vacuum pump comprising:

a cylindrical rotor;

multiple heat insulating pins; and a stator having a cylindrical portion arranged with a predetermined gap in an outer peripheral side of the rotor and a fixing portion to be fixed to a pump base through the multiple heat insulating pins, wherein the heat insulating pins have a lower thermal conductivity than those of the stator and the pump base, and support the fixing portion, wherein a pin hole formed at the pump base and engaging with each heat insulating pin includes a hole-far-side small-diameter hole portion engaging with each heat insulating pin and a hole-inlet-side large-diameter hole portion configured such that a clearance is formed between the large-diameter hole portion and each heat insulating pin.

* * * * *